United States Patent [19]

Espenscheid et al.

[11] 3,996,128

[45] Dec. 7, 1976

[54] ISOBUTANE CONVERSION OF NAPHTHA IN PRETREATER DESULFURIZATION

[75] Inventors: Wilton F. Espenscheid, Princeton; Tsoung Y. Yan, Trenton, both of N.J.

[73] Assignee: Mobil Oil Corporation, New York, N.Y.

[22] Filed: Dec. 10, 1975

[21] Appl. No.: 639,563

Related U.S. Application Data

[63] Continuation-in-part of Ser. No. 456,586, April 1, 1974, abandoned.

[52] U.S. Cl. ..... 208/89

[51] Int. Cl.[2] ..... C01G 23/00

[58] Field of Search ..... 208/89, 58, 60

[56] References Cited

UNITED STATES PATENTS

| | | | |
|---|---|---|---|
| 3,105,811 | 10/1963 | Engel | 208/89 |
| 3,291,723 | 12/1966 | Blue | 208/89 |
| 3,314,878 | 4/1967 | Kozlowski | 208/58 |
| 3,409,539 | 11/1968 | Paterson | 208/60 |
| 3,497,448 | 2/1970 | Hamner et al. | 208/60 |
| 3,884,797 | 5/1975 | Alley, Jr. et al. | 208/89 |

*Primary Examiner*—George Crasanakis
*Attorney, Agent, or Firm*—Charles A. Huggett; Raymond W. Barclay; Claude E. Setliff

[57] ABSTRACT

In a hydrocarbon conversion process for the catalytic desulfurization of a hydrocarbon feedstock the process is carried out at a low hydrogen partial pressure to obtain formation of a low sulfur product and conversion to butanes and propane, as desired, wherein the iso$C_4$/n-$C_4$ ratio is high, the process being carried out in the presence of an active, stable and selective catalyst containing at least one noble metal component incorporated with a crystalline aluminosilicate. A pressure from 100 to below 500 psig is used. The process contemplates simultaneously pretreating reformer feedstock in the presence of a hydrocracking catalyst with controlled hydrocracking thereof. Preferred highly effective catalysts are those containing palladium incorporated with a crystalline aluminosilicate zeolite.

9 Claims, No Drawings

ISOBUTANE CONVERSION OF NAPHTHA IN PRETREATER DESULFURIZATION

CROSS REFERENCE TO RELATED APPLICATIONS

This application is a continuation-in-part of U.S. application Ser. No. 456,586, filed Apr. 1, 1974 now abandoned.

BACKGROUND OF THE INVENTION

1. Field of the Invention

This invention relates to desulfurization, and in particular to simultaneously pretreating a hydrocarbon feedstock for reforming and conversion thereof to isobutane.

2. Description of the Prior Art

Naphtha stocks, e.g. napthas of $C_6$-400° F., are generally treated in refinery operations by catalytic reforming in which the naphthenes contained in the naphtha are dehydrogenated to aromatics and cyclopentanes are isomerized to cyclohexanes. Some cracking of naphthenes occurs under controlled reaction conditions. The typical catalyst used in reforming is platinum on an alumina base (U.S. Pat. Nos. 3,110,703 and 2,772,217) the platinum acting as a dehydrogenation component; platinum-rhenium catalysts have also been used. The main hydrocarbon product from the reformer is combined with hydrocarbon products of other operations to also provide high octane gasoline products. A low pressure hydrogen is a by-product.

However, naphtha feedstocks may contain high levels of sulfur or sulfur compounds to seriously affect the reforming catalyst. Reformer feeds are therefore usually subjected to a desulfurization step in the presence of hydrogen, termed "pretreating" (U.S. Pat. No. 2,724,683). U.S. Pat. No. 3,743,594 discloses such a process using a Group VIII metal component on a "layered" crystalline aluminosilicate to prevent hydrocracking. Crystalline zeolitic aluminosilicate are said to result in excessive hydrocracking. U.S. Pat. No. 2,885,352 also describes hydrodesulfurization; hydrocracking of a desulfurized gas oil and other stocks is discussed.

Hydrocracking is a known operation which involves cracking a hydrocarbon feedstock to smaller molecules in the presence of hydrogen. Stocks boiling in the range of 400° to about 1100° F, such as virgin heavy, light vacuum and coker gas oils, gas oil from cracking processes, furfural extracts and mixtures of these have generally been cracked under pressures ranging from 1000 to 3000 psig.

Hydrocracking catalysts may include crystalline aluminosilicate zeolites in a matrix (U.S. Pat. No. 3,702,818) and contain a hydrogenation component, usually a Group VIII metal. A very desirable product from the hydrocracking step is isobutane which, when combined with olefins in an alkylation process, can produce high octane gasolines.

Naphtha stocks have been subjected to hydrocracking (U.S. Pat. No. 3,579,434) at 2000 psig using a palladium on chelated aluminosilicate zeolite Y which had been treated with dimethyl sulfoxide (DSMO), with conversions to $C_1$–$C_5$ of 39% to 70% by volume. Chelation is taught therein as a required treating step. There is no indication that sulfur is removed. The hydrogen circulation was 7500 scf/b of naphtha.

U.S. Pat. No. 3,427,243 discloses hydrocracking with noble metal-containing zeolites. The pressures required are above 500 psig.

Other patents of interest are U.S. Pat. Nos. 3,458,433 and 3,781,199.

SUMMARY OF THE INVENTION

It has now been discovered that a reformer feedstock of $C_6$–400° F containing over 5 ppm of sulfur may be subjected to desulfurization to 5 ppm of sulfur or less in the presence of hydrogen and a catalyst having both hydrogenation-dehydrogenation and cracking functionality, and by proper adjustment of reaction temperature or catalyst poisoning, simultaneously whenever desired converting said feedstock to light hydrocarbons of any conversion level desired, to obtain production of butanes and propane and a high isobutane/n-butane ratio. Stated another way, the invention involves a process wherein a naphtha feedstock containing over 5 ppm of sulfur is pretreated prior to reforming by contact with a supported noble metal catalyst under desulfurization conditions including a temperature of between about 400° F and about 725° F in the presence of hydrogen at a pressure of at least 100 but less than 500 psig and a liquid hourly space velocity of from 1 to 6 to reduce the sulfur content of said feedstock to 5 ppm or less, the improvement which comprises increasing, from time to time responsive to the relative demand for alkylate and reformate, the aforenoted temperature of desulfurization by at least 10° F to achieve an increase yield of isobutane in said pretreater, conducting the effluent from said pretreater to a separation zone wherein an isobutane-rich stream is separated from residual product, conducting said isobutane-rich stream in an alkylation unit and conducting said residual product to a catalytic reformer.

DESCRIPTION OF SPECIFIC EMBODIMENTS

The low-pressure desulfurization process of this invention involves the treatment of hydrocarbon feedstocks that are low in aromatics, and preferably containing naphthcnes. The feed may also contain paraffins and some olefins. Such feedstocks as light or heavy virgin naphtha, coker gasoline and cracked gasoline stock and kerosene may be used. The preferred feedstock is a naphtha boiling at a temperature of 150° to 400° F. Particular stocks include $C_6$–200° F light naphtha, sulfur-containing reformer feedstock, e.g. $C_6$–380° F, and Arabian light naphtha.

The process of this invention particularly involves (1) desulfurizing the feedstock to 1 ppm of sulfur or less and passing at least a portion of the product to a reforming operation or (2) as desired, desulfurizing and simultaneously converting up to 90% of the feedstock to butanes and propanes. This invention contemplates pretreating a naphtha stock, at a temperature from 400° to 725° F and in the presence of low pressure hydrogen from at least 100 to less than 500 psig., to 1 ppm. of sulfur, while simultaneously converting the feedstock to produce desired quantities of butanes and propane whereby the isobutane:normal butane ratio is at least 2.5:1. In using the temperature control in this process, the temperature $T_c$ to achieve at least 5% conversion to $C_3$ and $C_4$ is at least 10° F. higher than the minimum temperature $T_s$ to obtain 1 ppm. sulfur. The selectivity of the process for desulfurization and/or conversion can be further controlled by the on-off poisoning of the catalyst with from about 1 to 100 ppm.

of nitrogen supplied by ammonia or an amine. The effect is to temporarily reduce the hydrocracking conversion partially or completely without affecting desulfurization substantially.

An important phase of this invention involves utilizing the conventional pretreater for removing sulfur from naphtha feedstocks to as low as 1 ppm. sulfur for reformer feed and simultaneously as a hydrocracking reactor to yield butanes and propane. Often during a yearly refinery operation, product requirements vary from one season to another. Gasoline pools may require increased production of reformate in which high octane products are manufactured. At other times, requirements for alkylate production, in which isobutane is alkylated by reaction with olefins in a conventional alkylation unit for preparation of gasolines, increase. Thus the pretreater may be used in its normal operation of desulfurizing naphthas prior to the reforming stage while at the same time hydrocracking the stock under controlled conditions to produce lower alkanes as a portion of the product. The effluent from the pretreater may be split into reformer feed and alkylation feed by distilling off the lower alkanes.

The conditions for the pretreating and/or conversion process of this invention involves heating the sulfur-containing naphtha feed to 400° to 725° F. and preferably 450° to 700° F., in the presence of hydrogen, at pressures ranging from 100 to less than 500 psig., and liquid hourly space velocitites (LHSV) of from 1 to 6 and in the presence of an active, stable, selective hydrocracking catalyst. A cobalt-molybdenum on alumina catalyst which is capable of reducing the sulfur level of crude stock is the conventional pretreating catalyst, but has poor conversion activity. At sufficiently low pressures and temperatures in these ranges, the feedstock can be dehydrosulfurized to 1 ppm. or lower without significant conversion. Yet, when seasonal requirements for lower alkanes are desired for alkylation operations, by merely increasing only the temperature, increased amounts of butanes and propane can be produced. Significantly, the feedstock can be treated to produce simultaneously both reformer feed and alkylation feed streams in almost any desired proportions.

In particular, the formation of isobutane is of value during a typical operating season. Although this requirement fluctuates according to the season (and the feedstock quality), a pretreating system operating on low hydrogen pressure which can simultaneously produce isobutane whenever required is extremely desirable. The pretreater containing a stable hydrocracking catalyst according to this invention will continue to provide product of low sulfur content.

The preferred process of this invention involves the use of a catalyst which can pretreat a naphtha feedstock or other reformer feedstock containing a high level of sulfur components, at an elevated minimum temperature ($T_s$) to reduce the sulfur content to 1 ppm. or convert at least about 5% by weight of the feedstock to butanes and propane at a minimum temperature ($T_c$). The minimum difference of $T_c$-$T_s$ must be 10° F. A preferred maximum for $T_c$ is bout 675° F., but usually no higher than about 650° F. The $T_c$-$T_s$ differential should not fall below 10° F.

We have discovered that this process is susceptible to yield butane products in a minimum ratio of 2.5:1 of isobutane to normal butane (i:n), and more often 3:1 or higher. Accordingly, we are able to produce at least about 4% by weight of isobutane at a temperature $T_c$ of from 25° to 40° F. higher than $T_s$, and the i:n ratio is at least 2.5.

While not wishing to be limited to a particular hydrocracking catalyst, we find that a catalyst consisting of a noble metal component, such as platinum, palladium, rhodium, and the like, supported on a silica, alumina, zirconia, thoria, or silica-alumina, silica-zirconia, or any other combination of these oxides can be used. Clay-derived supports are also useful. Most preferred are the crystalline aluminosilicates or zeolites, which have extremely good cracking properties. Of these, zeolite Y, either hydrogen zeolite Y or ammonium-exchanged zeolite Y, is especially adapted for such use. Of the noble metals, most preferred is palladium. Palladium on zeolite Y is of greatest interest. We prefer to use catalysts containing from 0.1% to 5% by weight of noble metal component.

The zeolite may be treated by base exchanging the sodium ions in the zeolite with ammonia or ammonium chloride, then, either chelated or not, subjected to washing or steaming, and drying. The metal component is incorporated with the zeolite in a suitable solution of the metal salt. Aqueous solutions of chloroplatinic acid or platinum (ammine) chloride or palladium chloride or palladium nitrate may be used to contact the zeolite and the resulting product calcined. The use of dimethylsulfoxide (DMSO) either as a pretreating step for the zeolite or as the medium for incorporating the metal component has provided noteworthy catalysts. As an alternative to DMSO treatment, the palladium-zeolite Y catalyst may be prepared without DMSO by completely drying the catayst in a vacuum prior to calcination.

In another aspect of this invention, the catalysts employed herein, in particular DMSO-treated, non-chelated zeolite Y containing palladium, have been found useful as low pressure hydrocracking catalyst for naphthas, kerosene and other distillate products. In contrast to that catalyst described in U.S. Pat. No. 3,553,102, the catalyst of this aspect of the invention requires no chelation. The hydrocarbon stock cracked in that patent was a blend containing coker and TCC stock, not a naphtha, and the pressure was at 1500 psig. Normal hydrocracking pressures may range from 1000 psig. to 2500 psig. The hydrocracking operation of this aspect of the invention may be carried out at from 250 to 500 psig.

The following examples are intended only as illustrations of the various aspects of this invention and do not represent limitations thereof.

EXAMPLE 1

A zeolite Y was ammonium exchanged with ammonium chloride and chelated with ethylenediamine tetraacetic acid. The sodium content was about 0.08%, the silica-alumina ratio was 6.67 and the ammonium-/aluminum ration was 0.823. The percent crystallinity was 79%.

This chelated $NH_4Y$ was dried and 12 grams was added to 150 grams of dry DMSO. To the solution was added a water solution of 0.33 gram of palladium (hexammine) chloride, $[Pd(NH_3)_6Cl_2]$, dissolved in 25 ml of water. The mixture was allowed to stand 3 hours, then filtered and the solids dried for 16 hours at 230° F. The dried solids were calcined by heating at 5° C. per minute to 500° C. and held at that temperature 3 hours. Upon cooling, the solids were pelleted and crushed to 18 to 30 mesh particles. These particles were calcined as before, except to 375° C. The resulting catalyst, which contains 1% by weight of palladium, is referred to as Pd/HY(Ch).

EXAMPLE 2

Catalyst Pd/HY(Ch) was used to hydrocrack in a single stage a Buffalo straight-run kerosene of 400° to 500° F. boiling range, 40° API gravity, 0.2% by weight of sulfur and 150 ppm. of nitrogen. The hydrocracking conditions were:

| | |
|---|---|
| Pressure: | 400 psig. |
| $H_2$ circ.: | 3000 SCF/B |
| LHSV: | 1 v/v |
| Recycle Cut: | 300° F. |

The temperature was adjusted to obtain 60% conversion per pass; product samples were analyzed periodically. The following results were obtained:

Table I

| Product Yield, wt. % | Days on Stream 2.6 | 3.1 | 6.1 | 7.1 |
|---|---|---|---|---|
| $C_1$ | — | — | — | — |
| $C_2$ | & 0.1 | & 0.1 | & 0.2 | & 0.2 |
| $C_3$ | 3.2 | 4.0 | 3.4 | 3.5 |
| $iC_4$ | 15.8 | 16.1 | 12.3 | 12.3 |
| $nC_4$ | 4.1 | 3.8 | 3.9 | 3.9 |
| $C_5$/180 | 17.9 | 17.8 | 18.8 | 18.8 |
| 180/300 | 61.1 | 60.6 | 63.9 | 63.9 |
| Total | 102.2 | 102.4 | 102.5 | 102.6 |
| i:n | 3.84 | 4.2 | 3.14 | 3.14 |
| Reactor Temp., ° F. | 598 | 610 | 610 | 610 |
| Actual* Conv. % | 54 | 67 | 65 | 67 |
| Hydrogen Consumption, scf/b | 1240 | 1325 | 1330 | 1330 |

*Vol. % feed converted to material boiling below 300° F. ($C_1$-300).

EXAMPLE 3

In this example, an Arabian light naphtha 290°–380° F. is hydrocracked 60% to $C_1$-290° F. at 400 psig., 1 LHSV and 3000 scf/b of hydrogen. The catalysts used in four separate runs were 1% by weight of palladium on hydrogen or ammonium zeolite Y (Pd/HY, Pd/$NH_4$Y). In the preparation, two catalysts were treated with DMSO, two were not, two were steamed and two were not. None of the zeolites was chelated. The letter designations for each step refer to the corresponding letters in Table II.

Catalyst 1 was treated as follows:

a. In a suitable reactor, 500 grams of sodium zeolite Y, NaY, and 2.5 liters of 1.5 molar solution of ammonium sulfate were mixed together and heated at 100° C. for 2 hours. The solids were filtered out and mixed with another 2.5 liters of 1.5 molar ammonium sulfate solution a 100° C., for 16 hours. The solids were filtered out. This step was repeated three times. Finally, the solids were washed with 8 liters of hot water and dried at 230° F.

e. The above dried solids, (25 grams), was mixed with 25 ml of water containing 0.29 grams of $Pd(NH_3)_4Cl_2.6H_2O$. The mixture was allowed to stand for 3 hours then filtered and the solids dried for 16 hours at 230° F. The solids were pelleted and crushed to sieve size of 12–20 mesh.

f. The resulting particles of Step (e) were calcined at 325° C. for 16 hours.

Catalyst 2 was treated as follows:

a. The same steps as used for Catalyst 1, (a) above.

d. The dried solids, (20 grams), of Step (a) were mixed with 100 ml of DMSO and heated at 65° C. for 18 hours. The solids were filtered off, dried for 15 hours at 230° F., then allowed to cool. 2e. The solids from Step (d) was mixed with 15 ml of water containing 0.29 gram of $Pd(NH_3)_4Cl_2.6H_2O$. The mixture was warmed to 65° C. and let stand for 1 hour. The solids were filtered off and dried at 230° F. for 3 hours.

f. The solids from Step (e) were treated as in Step (f) above.

Catalyst 3 was treated as follows:

a. An ammonium zeolite Y, $NH_4$Y, was prepared by typical ammonium exchange techniques.

b. The $NH_4$Y of Step (a) was pelleted, crushed to 12–20 mesh size, then subjected to steam at 1000° F., at 10 ml $H_2O$ per minute for 90 minutes.

c. The product of Step (b), (25 cc), was mixed with 1 liter of 0.25 normal ethylenediamine tetraacetic acid, the mixture adjusted to a pH of over 7 with ammonium hydroxide and refluxed for 90 minutes. The solids were filtered off, washed with 200 ml of water and dried for 3 hours at 230° F.

e. The solids of Step (c), (6.1 grams), were mixed with 0.16 gram of $Pd(NH_3)_4Cl_2.6H_2O$ in 10 ml of water. The mixture was heated to 140° F. for 1 hour. The solids were filtered off, dried for 16 hours at 230° F.

f. The solids of Step (e) were calcined for 3 hours at 325° C.

Catalyst 4 was treated as follows:

a. The $NH_4$Y of Catalyst 3 was prepared.

b. Steaming was performed as in Step (b) above.

c. The product of Step (b), (50 cc), was exchanged again with 1 molar solution of ammonium sulphate over a 3-hour period, then filtered off, water-washed, and dried for 16 hours at 230° F.

d. The product of Step (c), (27 cc), was mixed with 500 ml of DMSO, and the mixture held at 65° C. with stirring for 16 hours. The solids were filtered and dried for about 20 hours at 230° F.

e. The product of Step (d), (15 grams), was mixed with 25 ml of water containing 0.42 gram of $Pd(NH_3)_4Cl_2.6H_2O$ and the mixture warmed to 160° F. for 3 hours. The solids were filtered off and dried for 3 hours at 230° F.

f. The product of Step (e) was calcined for 15 hours at 325° C.

Below are the steps of preparation and the corresponding catalyst activity temperature required for 60% conversion from 290°–380° F. to $C_1$-290° F., and the ratio of isobutane to normal butane (i:n).

Table II

| | Catalyst Preparation | Pd/HY 1 | 2 | Pd/$NH_4$Y 3 | 4 |
|---|---|---|---|---|---|
| a) | NaY - $NH_4^+$exchange | x | x | x | x |
| b) | $NH_4$Y - steam | | | x | x |
| c) | HY - $NH_4^+$exchange | | | x | x |
| d) | (3) - DMSO impregnation | | x | | x |
| e) | (4) - $Pd^{++}$ exchange | x | x | x | x |
| f) | (5) - Calcination | x | x | x | x |
| | Catalyst Activity Temp., ° F. | 622 | 506 | 584 | 506 |
| | i:n | 2.4 | 4.4 | 3.7 | 4.8 |

As may seen, all catalysts effected hydrocracking under mild conditions and produced isobutane; the DMSO-treated products provided better results. Lower conversion temperatures were required and higher i:n ratios were obtained.

EXAMPLE 4

The use of a non-chelated hydrocracking catalyst in a conventional pretreater for reformer feedstock is a particularly important phase of a present invention. The feed to the pretreater may be hydrodesulfurized to low sulfur content (1 to 2 ppm) and simultaneously cracked to produce controlled amounts of butanes, having a high i:n ratio, and propane.

The catalyst used in this example was prepared by mixing 20 grams of an ammonium zeolite Y and 100 ml of DMSO, and the mixture stirred at 65° C. for 18 hours. The solids were filtered off and dried for 2 hours at 230° F. The dried solids were mixed with 0.29 grams of $Pd(NH_3)_6Cl_2$ dissolved in about 25 ml of water for 3 hours. The resulting solids were filtered out, dried for 16 hours at 230° F. and then calcined at 365° C. for 15 hours. The solids were then treated as in Example 1. The product was a 1% Pd/HY.

An Arabian light naphtha was subjected to pretreating using the above product as catalyst. The feed characteristics are as follows:

| | | |
|---|---|---|
| Gravity, °API | - | 60.7 |
| Sulfur, ppm | - | 330 |
| Nitrogen, ppm | - | 0.2 |
| Boiling range | - | $C_6$-365° F. |

The pretreatment conditions are as follows:

| | | |
|---|---|---|
| Pressure, psig. | - | 400 |
| $H_2$ Circ., scf/b | - | 3000 |

The temperatures and LHSV were varied for a series of runs. The results are as follows:

Table III

| Temperature, ° F. | 450 | 478 | 502 | 502 |
|---|---|---|---|---|
| LHSV v/v hr. | 1 | 1 | 1 | 3 |
| Product Yield, wt. % | | | | |
| $C_1$ | — | — | — | — |
| $C_2$ | — | — | 0.2 | — |
| $C_3$ | 0.4 | 1.1 | 2.9 | 0.6 |
| $iC_4$ | 1.6 | 5.2 | 11.9 | 2.0 |
| $nC_4$ | 0.2 | 0.9 | 2.3 | 0.4 |
| $C_5$ | 1.1 | 5.2 | 11.1 | 2.0 |
| i:n ($C_4$) | 8.0 | 6.0 | 5.3 | 5.0 |
| Sulfur, ppm | 19 | 0.7 | 0.4 | 2.8 |

These results show the flexible manner of operating a pretreater throughout a year's operation. The temperature for achieving desired sulfur level of 1 ppm is interpolated as 465° F. at 1 LHSV and 525° F. at 3 LHSV. At 465° F. and 1 LHSV, the product yield of lower boiling material would be (by interpolation) $C_3$: 0.7%, $iC_4$: 3.4%, $nC_4$: 0.5% and $C_5$: 3.1%; or only 7.7% cracked products, the bulk of the pretreater effluent being passed on to the reforming unit. By increasing the temperature to 502° F., the cracking activity would be increased to a total of over 28% lower products.

EXAMPLE 5

To evaluate the effectiveness of the hydrocracking catalyst of Example 4 to remove sulfur from the same feedstock without substantial hydrocracking, nitrogen was circulated into the reactor in the form of a 50/50 wt./wt. mixture of primary and secondary butyl amines. The amines have the effect of temporarily poisoning the cracking characteristics of the catalyst. The results are as follows:

Table IV

| Temperature, ° F. | 554 | 576 | 574 | 603 |
|---|---|---|---|---|
| LHSV v/v hr. | 3 | 3 | 3 | 3 |
| Nitrogen, ppm | 55 | 55 | 100 | 100 |
| Product Yield, wt. % | | | | |
| $C_1$ | — | — | — | — |
| $C_2$ | — | — | — | — |
| $C_3$ | — | — | — | — |
| $iC_4$ | — | — | — | 0.3 |
| $nC_4$ | — | — | — | — |
| $C_5$ | — | — | — | 1.6 |
| Sulfur, ppm | 3.0 | 1.1 | 1.7 | 1.2 |

Thus, as indicated by the results of Table IV, if cracked product requirements are light, but intermittent reformer requirements unexpectedly were increased, temporary circulation of nitrogen-containing recycle gas could inhibit cracking for the desired period of time, after which cracking could be resumed. Other nitrogren sources, such as ammonia and amines of from 1 to about 20 carbon atoms could be used.

EXAMPLE 6

Typical CHD conditions were employed to hydrocrack a $C_6$-200° F. light naphtha to produce from 49% to 53% by weight butanes and propane. The pressure was 450 psig., the operation was a single pass treatment over a 0.5% Pd/HY catalyst prepared as follows:

An ammonium zeolite Y was steamed at 1000° F. for 90 minutes. The product (10 grams) was mixed with 50 ml of DMSO for 16 hours at 65° C. and dried at 230° F. for 17 hours. The solid (9.4 grams) was mixed with 0.12 gram of $Pd(NH_3)_6Cl_2$ dissolved in 10 ml of water. The mixture was allowed to stand 1 hour, filtered, dried for 8 hours at 230° F. and calcined for 17 hours at 325° C.

The feed to be cracked was a $C_6^+$ feedstock containing 0.8 wt.% of isopentane, 2.6 wt.% of normal pentane and 96.6 wt.% of $C_6$ and higher components (up to 200° F. boiling point). The gravity was 63.3 °API, 1.2 ppm sulfur, 0.2 ppm nitrogen. The hydrogen circulation rate was 300 scf/b. The feed and product components were as follows (in weight percent):

Table V

| Temperature, ° F. | — | 620 | 660 |
|---|---|---|---|
| LHSV | — | 1.0 | 3.0 |
| Components | Feed | Products | |
| $C_1$ | — | — | 0.1 |
| $C_2$ | — | & 0.2 | 0.4 |
| $C_3$ | — | 17.5 | 15.8 |
| $iC_4$ | — | 31.2 | 28.2 |
| $nC_4$ | — | 4.7 | 5.0 |
| $iC_5$ | & 0.8 | 9.4 | 9.6 |
| $nC_5$ | 2.6 | 4.4 | 5.2 |
| cyclopentane | & — | 1.3 | 2.4 |
| $C_6^+$ | & 96.6 | 33.4 | 35.7 |
| Total | 100.0 | 102.1 | 102.4 |
| i:n($C_4$) | & — | 6.6 | 5.6 |
| $C_7^+$ | & 43.5 | 5.2 | 3.6 |
| Paraffins | 58.3 | 78.9 | & — |
| Olefins | 0.0 | 0.0 | — |
| Naphthenes | 38.6 | 20.9 | — |

Table V-continued

| | | | |
|---|---|---|---|
| Aromatic | 3.1 | 0.2 | — |
| RON+0($C_6^+$) | 67 | 76 | — |
| $H_2$ Cons., scf/b | & — | 999 | & 1122 |

These results show that by simply increasing the temperature of a CHD unit, increased butanes and propanes can be produced (50% or higher), isobutane to normal butane ratios of 5.6 to 6.6:1 are achieved and the less valuable methane and ethane are no more than 0.5% (at 3 LHSV). Almost a third of the $C_6^+$ feed is cracked, mostly the $C_7^+$ components. Ring-opening of the naphthenes occurred (38.6% down to 20.9%). The RON+O figure, which is the research octane number without added lead compounds, is increased 9 points indicating increased $C_6$-branched paraffins in the product. The $C_6$+ product would be an acceptable gasoline blending component.

The low sulfur content of reformer feeds is considered important in view of the use of new reforming catalysts which are quite susceptible to sulfur poisoning. Although the conventional cobalt-molybdenum on alumina catalysts are capable of reducing the sulfur to these low levels (of 1 to 2 ppm), they do not crack effectively. While the nickel-tungsten on zeolites are good cracking catalysts and have some utility in that function, they are not entirely satisfactory for achieving low sulfur levels. The following example illustrates this distinction.

EXAMPLE 7

An active, stable and selective catalyst was prepared by treating an $NH_4Y$ as follows:

$NH_4Y$ was steamed as in Example 6, and then mixed with the $Pd(NH_3)_6Cl_2$ water solution omitting the DMSO treating step. The resulting Pd/HY is understood to be a $Pd(NH_3)_4^{++}$-exchanged/HY. This material is maintained in a vacuum at 110° C. for 16 hours and then calcined in air at 325° C. It is believed that the vacuum-heat treatment removes essentially all water from the solids prior to calcining. The resulting product, 0.5% Pd/HY, is an excellent catalyst for hydrotreating hydrocarbon stocks.

This catalyst was used to desulfurize a $C_6$-365° F. Arabian light reformer feedstock of 330 ppm sulfur at 450 psig. hydrogen, 3 LHSV and at various temperatures up to 700° F. For comparison purposes, a nickel-tungsten on rare earth zeolite X catalyst (NiW/REX) and a cobalt-molybdenum on alumina ($CoMo/Al_2O_3$) were also used with this feedstock. Referring to the nomenclature, $T_s$ is the temperature required to desulfurize to 1 ppm sulfur and $T_c$, the temperature at which isobutane yield is 4% by weight. The results were:

Table VI

| Catalyst | Ex. 7 (Pd/HY) | NiW/REX | $CoMo/Al_2O_3$ |
|---|---|---|---|
| $T_s$, ° F. | below 600 | over 700 | 695 |
| $T_c$, ° F. | 633 | 595 | over 700, low $iC_4$ |
| $T_c$–$T_s$ | over 33 | below −105 | — |

The Pd/HY of Example 7 permitted a reduction of sulfur to the target level at 1 ppm at below 600° F. while the total $C_1$–$C_5$ produced was only 7%; at 633° F., $iC_4$ production was about 4%; at 653° F., $C_1$–$C_5$ was about 28%, with 10% $iC_4$. These results show the flexibility of using this catalyst in CHD operations while simultaneously effecting hydrocracking to any desired level.

As for the NiW/REX catalyst, the product still contained 2.7 ppm. of sulfur at 700° F. The total $C_1$–$C_5$ content at 600° F. was about 17%, with 6% isobutane produced, indicating little room for flexibility. The $CoMo/Al_2O_3$ catalyst provided for 1 ppm. sulfur at a very high temperature, 695° F. and substantially higher than the $T_s$ of Example 7 catalyst; however, at 700° F. total $C_1$–$C_5$ content was only about 4% and the isobutane less than 0.05%.

As previously stated the $T_c$–$T_s$ differential must be at least 10° F. for conversion of feedstock. However, the maximum operating temperature should not exceed 725° F. and preferably 675° F. to obtain satisfactory amounts of propane and butane. The ideal $T_c$–$T_s$ differential of 25° to 40° F. for achieving 4% isobutane and 1 ppm. sulfur is clearly achieved by the Pd/HY catalyst of Example 7.

Broadly, the aspects of this invention involve catalytic hydrodesulfurization with simultaneous low pressure hydrocracking and, in a more specific case, a catalyst of palladium incorporated with an unchelated hydrogen or ammonium exchanged zeolite Y, used for the said combined low severity hydrotreating process. Any obvious modifications of the invention herein described are understood to be within the scope of this invention as hereinafter claimed.

We claim:

1. In a process wherein a naphtha feedstock containing over 5 ppm of sulfur is pretreated prior to reforming by contacting said feedstock with a supported noble metal catalyst under desulfurization conditions including a temperature in the range of between about 400° F and about 725° F in the presence of hydrogen at a pressure of at least 100 but less than 500 psig and a liquid hourly space velocity of from 1 to 6 to reduce the sulfur content of said feedstock to 5 ppm or less and to produce propane and butanes, the improvement which comprises converting said feedstock to achieve at least 5% conversion to propane and butanes, including isobutane, by increasing the temperature in said range at least 10° F to achieve an increased yield of said isobutane in said pretreater, conducting the effluent from said pretreater to a separation zone wherein an isobutane-rich stream is separated from the desulfurized naphtha, conducting said isobutane-rich stream to an alkylation reactor and conducting said desulferized naphtha to a catalytic reformer.

2. The process of claim 1 wherein said desulfurization conditions reduces the sulfur content to a maximum of 1 ppm.

3. The process of claim 2 wherein at least 4% by weight of isobutane is produced at a temperature which is at least about 25° to 40° F above the temperature of desulfurization.

4. The process of claim 1 wherein the maximum desulfurization temperature is 650° F.

5. The process of claim 1 wherein the isobutane to normal butane weight ratio obtained in said conversion is at least 2.5:1 and the conversion temperature is about 30° F above the temperature of desulfurization.

6. The process of claim 1 wherein said catalyst comprises a noble metal on a crystalline aluminosilicate zeolite or on a support selected from the group consisting of silica, alumina, thoria, zirconia, and mixtures thereof.

7. The process of claim 6 wherein said catalyst comprises a noble metal on a crystalline aluminosilicate zeolite.

8. The process of claim 7 wherein said catalyst is palladium on a zeolite Y selected from the group consisting of a hydrogen Y and an ammonium Y.

9. The process of claim 8 wherein the palladium is incorporated with said zeolite Y before or after treatment of said zeolite with dimethylsulfoxide.

* * * * *

UNITED STATES PATENT AND TRADEMARK OFFICE

CERTIFICATE OF CORRECTION

PATENT NO. : 3,996,128

DATED : December 7, 1976

INVENTOR(S) : WILTON F. ESPENSCHEID and TSOUNG Y. YAN

It is certified that error appears in the above-identified patent and that said Letters Patent are hereby corrected as shown below:

Column 1, line 41, "aluminosilicate" should read --aluminosilicates--.
Column 4, line 58, "ration" should read --ratio--.
Column 5, line 9, "500°F" should read -- 550°F --,
Column 5, Table 1, delete "&" sign in all four columns in Table.
Column 6, line 8, "2e" should read --e--.
Column 8, line 51, "300" should read --3000--.
Column 8 & 9, Table V, Delete "&" sign in Table V.
Column 10, line 17, "butane" should read --butanes--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*